United States Patent [19]

McMullen

[11] 4,012,255

[45] Mar. 15, 1977

[54] OVERCOATED ELECTROSTATOGRAPHIC PHOTORECEPTOR

[75] Inventor: Thomas B. McMullen, Webster, N.Y.

[73] Assignee: Xerox Corporation, Stamford, Conn.

[22] Filed: May 6, 1976

[21] Appl. No.: 683,987

[52] U.S. Cl. ..... 96/1.5; 96/1.8; 428/327; 428/461

[51] Int. Cl.[2] ..... G03G 5/04

[58] Field of Search ..... 96/1.5, 1.8; 252/501

[56] References Cited

UNITED STATES PATENTS

| | | | |
|---|---|---|---|
| 3,146,145 | 8/1964 | Kinsella | 96/1.5 X |
| 3,251,686 | 5/1966 | Guldlach | 96/1.5 |
| 3,256,002 | 6/1966 | Hudson | 96/1.4 X |
| 3,268,351 | 8/1966 | Van Dorn | 96/1.4 X |
| 3,281,240 | 10/1966 | Cassiers et al. | 96/1.5 |
| 3,434,832 | 3/1969 | Joseph et al. | 96/1.5 |
| 3,617,265 | 11/1971 | Petruzella | 96/1.5 X |
| 3,682,689 | 8/1972 | Dueltgen et al. | 96/1 R X |
| 3,687,659 | 8/1972 | Komiya et al. | 96/1.5 |
| 3,799,901 | 3/1974 | McCann et al. | 260/29.6 PM |
| 3,859,090 | 1/1975 | Yoerger et al. | 96/1.5 |

*Primary Examiner*—Roland E. Martin, Jr.
*Attorney, Agent, or Firm*—James J. Ralabate; James Paul O'Sullivan; Jerome L. Jeffers

[57] ABSTRACT

Disclosed is a novel overcoating material for electrostatographic photoreceptors. The composition comprises an organic, crosslinkable, polymeric composition having dispersed therein a particulate, wax-like, normally solid, low molecular weight tetrafluoroethylene telomer. Application of the composition to an electrostatographic photoreceptor to form a thin uniform layer results in improvement in copy quality and reduction in surface friction of the device. When the photoreceptor employs a selenium/arsenic alloy as the photoconductor, print deletions normally associated with the photoconductor are eliminated.

9 Claims, No Drawings

OVERCOATED ELECTROSTATOGRAPHIC PHOTORECEPTOR

BACKGROUND OF THE INVENTION

This invention relates to the art of electrostatographic copying, an electrostatographic photoreceptor and to a method of treating such a photoreceptor for use in electrostatographic copying machines. This form of copying, originally disclosed by C. F. Carlson in U.S. Pat. No. 2,297,691, involves as an initial step the uniform charging of a plate or drum comprised of a conductive substrate normally bearing on its surface a non-conductive barrier layer which is covered by a layer of a photoconductive insulating material. This is followed by exposing the plate or drum to activating radiation in imagewise configuration which results in dissipation of the electrostatic charge in the exposed areas while the non-exposed areas retain the charge in a pattern known as the latent image. The latent image is developed by contacting it with an electroscopic marking material commonly referred to as toner. This material is electrostatically attracted to the latent image which is, by definition, in the configuration of those portions of the photoreceptor which were not exposed to the activating radiation. The toner image may be subsequently transferred to paper and fused to it to form a permanent copy. Following this, the latent image is erased by discharging the drum and excess toner is cleaned from it to prepare the drum for the next cycle.

The photoconductive insulating material is characterized in that it has a comparatively high electrical resistance in the dark which resistance decreases significantly upon exposure to activating radiation. Both organic materials, such as 2,4,7-trinitro-9-fluorenone in poly(vinylcarbazole), and inorganic materials, such as amorphous selenium, have been successfully used as the photoconductive material in electrostatographic copiers.

Amorphous selenium has many desirable properties which render its use highly beneficial in electrostatographic copying machines. However, the advent of high speed copiers which make only one or two copies per drum revolution has necessitated the use of photoconductive materials which discharge at a faster rate than pure selenium. This is the case since the increase in copying speed is obtained by increasing the speed of drum revolution, hence lower exposure. Accordingly, the photoreceptor must go through the charge, expose, develop, transfer, discharge and clean cycle very rapidly. Researchers have discovered that the photodischarge rate for the same light intensity can be increased by combining the selenium with arsenic to form an alloy. In addition the use of selenium/arsenic alloys results in a photosensitive device which is sensitive to longer wavelengths of light than are those which employ pure selenium as the photoconductor. This concept is more fully disclosed by Ullrich in U.S. Pat. No. 2,803,542. Thus, alloys of selenium containing from about 0.3 percent up to about 48.7 weight percent arsenic are advantageously used as the photoconductive material in high speed electrostatographic copiers. The arsenic containing selenium alloys have been found to suffer from a drawback which has come to be known as print deletion. This phenomena is observed as blank areas in the copy which get progressively larger until the copy quality becomes unacceptable. It is not fully understood what causes print deletion, but it is believed that chemicals found in the ambient of some locations where copiers are placed contain constituents which react with arsenic in the photoconductor to form a conductive reaction product which allows lateral migration of the charge immediately after the charging step. As a result, no latent image is formed in these areas and print deletion results.

One solution to the aforementioned print deletion problem is disclosed in copending application Ser. No. 558,027 filed Mar. 13, 1975. This application discloses a particular polymeric material useful for overcoating electrostatographic photoreceptors. The overcoating material is disclosed as comprising a crosslinkable polymeric composition of:

i. a first polymer which is the addition polymerization product of methyl methacrylate, n-butylmethacrylate and acrylic or methacrylic acid, and ii. a second polymer which is the addition polymerization product of styrene and maleic anhydride This overcoating has proven itself highly effective when used in conjunction with selenium/arsenic photoconductors. Its use virtually eliminates the print deletion problem and has also been found to provide a significant improvement in copy quality. In addition, it has been observed that light fatigue problems associated with selenium/arsenic photoconductors are significantly reduced when the photoconductor is overcoated with this material.

Certain electrostatographic copiers employing selenium/arsenic photoconductors are cleaned by the application of a flexible doctor blade thereto and providing relative motion between the blade and the drum bearing the photoconductor on its surface. The doctor blade is typically made of a flexible material, e.g. polyurethane, in order for it to conform to the irregularities in the drum's surface. The use of a flexible blade necessitates the application of some lubricating material to the drum's surface to reduce the friction between the blade and the drum and thereby prevent blade chatter and foldover. It would simplify operation of the cleaning mechanism if the friction between the cleaning blade and the drum could be reduced to thereby avoid the need for the periodic application of a lubricating material to the drum's surface.

It would be desirable and it is an object of the present invention to provide a novel overcoating for electrostatographic photoreceptors.

An additional object is to provide such an overcoating which enhances the quality of copies produced by the overcoated photoreceptor.

Another object is to provide such an overcoating which reduces or eliminates the problems of copy deletion and light fatigue recovery associated with the use of selenium/arsenic alloys as photoconductors.

A further object is to provide such an overcoating which exhibits a significant reduction in friction between its surface and the surface of flexible doctor blades used to clean it.

SUMMARY OF THE INVENTION

The present invention is directed to an improved electrostatographic photoreceptor which comprises:

a. a conductive substrate;

b. a layer of a selenium/arsenic alloy as photoconductive insulating material in operative contact with the conductive substrate; and c. an overcoating uniformly covering the exposed surface of said photoconductive material, the overcoating comprising:

1. an organic overcoating material comprising a crosslinkable polymeric composition of:

i. a first polymer which is the addition polymerization product of methyl methacrylate, n-butylacrylate and acrylic or methacrylic acid, and ii. a second polymer which is the addition polymerization product of styrene and maleic anhydride, together with 2. a particulate, wax-like, normally solid, low molecular weight tetrafluoroethylene telomer in an amount from about 15 to 75 weight percent of said organic overcoating material.

DETAILED DESCRIPTION AND PREFERRED EMBODIMENTS

The invention is predicated on the discovery that overcoating the photoconductive insulating layer of an electrostatographic photoreceptor with a thin but effective layer of the previously described overcoating material imparts unexpected beneficial properties to the photoreceptor. The present overcoating is beneficial in terms of eliminating print deletion and reducing the problem of slow recovery from light fatigue associated with the use of certain photoconductive alloys. In addition, the improvement in copy quality obtained with the use of the polymeric overcoating by itself is not affected by the addition of the tetrafluoroethylene telomer. The addition of this material provides the beneficial result of reducing friction between the photoreceptor surface and flexible doctor blades used to clean it to such an extent that external lubricants are not required. Surprisingly, the tetrafluoroethylene telomer is not abraded away from the overcoating surface during many cycles in which the overcoated photoreceptor is cleaned with a flexible doctor blade.

Typical organic overcoating materials contemplated for use in the instant invention comprise the product of the addition polymerization of methyl methacrylate, n-butylacrylate and acrylic or methacrylic acid as the first polymer. The second polymer, sometimes referred to as the leveling resin, is the product of the copolymerization of styrene and maleic anhydride. In a typical overcoating, the first polymer will account for from about 75 to 90 mole percent of the non-fluorine containing portion of the film and will comprise from about 45 to 65 mole percent methyl methacrylate, 25 to 40 mole percent n-butylacrylate and 5 to 15 mole percent acrylic or methacrylic acid. The leveling resin will normally account for from 10 to 25 weight percent of the film and will comprise styrene and maleic anhydride in a mole ratio of from 2:1 to 1:1. Since copolymers of styrene and maleic anhydride, usually referred to as SMA resins, typically contain a ratio of styrene to maleic anhydride of either 2:1 or 1:1, a composition in which the styrene to maleic anhydride ratio is between the extremes will necessarily contain a mixture of SMA resins. Those SMA resins having a 2:1 styrene/maleic anhydride ratio are generally preferred.

This material is conveniently applied from a synthetic latex, i.e. a finely divided dispersion of polymer particles in an aqueous carrier. Typically, the carrier will contain a basic material such as ammonia or an amine, e.g. isopropylamine, to form a salt with the weakly ionized carboxylic acid groups and thereby increase the solubility of the polymer. Such a latex dispersion is more fully described in U.S. Pat. No. 3,799,901. The above-described latex dispersion is available commercially under the tradename Solarian Floor Finish.

In order to incorporate toughness into the film formed by the latex dispersion, a metal crosslinking component is normally employed. Thus, by introducing a crosslinking material such as an oxide, hydroxide or salt of a polyvalent metal, e.g. zinc or zirconium, along with sufficient base to dissolve the aqueous dispersion of the polymer, the metal will serve to crosslink the polymer across carboxyl groups and form a tough film upon casting the dispersion. This crosslinking is ionic in nature and is believed to be represented by the following formula when ammonia is the base:

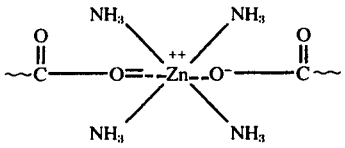

The use of metal crosslinking agents in conjunction with acrylic or methacrylic acid containing polymers is desirable due to the enhancement of the material's film forming capability achieved thereby. The incorporation of SMA resins into the polymer dispersion is especially advantageous when metal crosslinking agents are employed because the most serious problem with these systems is storage stability. This is the case because with no metal ions present, the solution is somewhat susceptible to gelling and floculation. The SMA resin acts as a leveling agent and serves the purpose of enhancing the freeze-thaw and heat stability of the coating formulation.

The aqueous latex solution will optionally contain, in addition to the two polymers, base and metal crosslinking agent, a volatile plasticizer. The plasticizer is normally present because of the desirability of formulating a material which upon application to the substrate will form a continuous film which exhibits a reasonably high level of abrasion resistance. In order to yield a continuous film, the coating composition must have a minimum film forming temperature (MFT) below the application temperature. In order for the film to wear well, its glass transition temperature (Tg) should be above its service temperature. Since minimum film forming temperature is a function of the polymer Tg and the plasticizer content, it is the practice of the coating industry to incorporate volatile plasticizer into the formulation to obtain a low MFT (before plasticizer evaporation) and a high Tg (after plasticizer evaporation). Examples of volatile plasticizers, in their descending order of volatility, are pyrrole, propylene glycol, n-octanol, hexylene glycol, dipropylene glycol methyl ether, tributyl citrate and tributoxyethyl phosphate. In addition, caprolactam is sometimes employed to serve the dual function of a volatile plasticizer and gloss enhancer in commercially available floor finishes.

To this latex dispersion is added the particulate tetrafluoroethylene telomer typically in the form of particles or particle agglomerates which range in size from 0.1 $\mu$ to 10 $\mu$ in their longest dimension. The tetrafluoroethylene telomer is a low molecular weight polymer prepared by the catalytic reaction of tetrafluoroethylene and typically ranges in molecular weight from about 500 to 100,000. Preferred materials range in molecular weight from about 1,300 to 40,000. These materials are wax-like and provide the requisite amount of lubricity to the polymeric overcoating.

Typically, the amount of tetrafluoroethylene particles contained in the overcoating will range from 15 to 75 weight percent of the overcoating with a range of from 25 to 50 weight percent being preferred. Too much of this material is undesirable lest the overcoating become opacified and too little will not provide the requisite lubricity. Upon addition of the tetrafluoroethylene particles to the latex solution, thorough mixing is employed to provide a uniform solution/dispersion which is uniformly applied to the photoreceptor by conventional coating techniques.

For purposes of the present invention, the thickness of the overcoating is not critical, although it will be apparent to those skilled in the art that some experimentation may be required to determine the optimum coating thickness for a given photoconductive material. Typical coating thicknesses range from about 0.1 to about 10 microns and preferably from about 1 to 3 microns.

As indicated above, the cause of causes of print deletion are not fully understood. One form of print deletion has been reproduced under controlled conditions. This form is known as amine induced deletion. It is believed that amines present in the ambient associated with high arsenic photoreceptors react with the surface of the photoreceptor to form a film which interferes with charge retention in this region and prevents a developable latent image from being formed. Application of the overcoating of the type defined herein not only overcomes amine induced print deletion but print deletion caused by other detrimental materials present in certain ambients. Furthermore, the copy quality is enhanced by the overcoating which is surprising because while the polymeric overcoating by itself enhances copy quality, it might be expected that the addition of the tetrafluoroethylene telomer to this material would have the opposite effect. It is also surprising that the tetrafluoroethylene particles are not abraded from the surface of the overcoating when it is cleaned with a flexible doctor blade. The fact that such erosion is not observed suggests that there may be formed some sort of quasi chemical bond between the tetrafluoroethylene and the non-fluorine containing polymers.

The present invention is further illustrated by the following example.

EXAMPLE I

An overcoating composition for use in the present invention is prepared as follows:

To an aqueous dispersion of Solarian Floor Finish obtained from the Armstrong Cork Company in May of 1974 is added 10 percent by weight of a tetrafluoroethylene telomer sold under the tradename Vydax 1000 by E. I. duPont de Nemours and Company. Analysis of the floor finish indicates that it is a latex containing about 20 weight percent of solids comprising colloidal sized particles of from about 70 to 80 weight percent of a ternary copolymer of from 45 to 65 percent methyl methacrylate, 25 to 40 percent n-butylacrylate and 5 to 15 percent methacrylic acid. In addition the material contains from 8 to 23 weight percent of an SMA resin in which the mole ratio of styrene to maleic anhydride is 2:1. A small amount of zinc is present as crosslinking agent and the formulation is also found to contain 1 to 2 percent tributoxyethyl phosphate, 4 to 6 percent caprolactam (monomer), 1 to 2 percent glycine, 0.5 percent ammonia and about 1 percent diethylamino ethanol. The tetrafluoroethylene telomer is found to have a molecular weight of from 25,000 to 35,000 and to be capped with methyl groups. This material is radiochemically tagged before its addition to the floor finish.

The solution is uniformly applied to an electrostatographic photoreceptor consisting of an aluminum drum coated with an alloy of about 63 percent selenium and 37 percent arsenic by applying a cotton pad saturated with the material to the drum surface and rotating the drum several times while moving the pad parallel to the axis of rotation. After application, the layer is dried to form a substantially uniform film.

The coated drum is operated in the normal xerographic mode and print samples are found to be excellent with a noticeable improvement in character sharpness and reduction in background being noted. Two thousand copies are run on the coated photoreceptor to determine if the tetrafluoroethylene telomer in the film will wear off. Because the sample is radioactive, any loss of the material will be detected radiochemically but no loss is detected. A significant reduction of friction is observed qualitatively. In addition, operating the machine with a polyurethane wiper blade and no external lubricant for 2000 cycles results in no blade chatter or foldover. Typically, polyurethane blades used to clean uncoated drums fold over in less than 1000 cycles when used without an external lubricant.

What is claimed is:

1. An improved electrostatographic photoreceptor which comprises:

a. a conductive substrate;

b. a layer of an alloy of selenium and arsenic as photoconductive insulating material in operative contact with the conductive substrate; and c. an overcoating uniformly covering the exposed surface of said photoconductive material, the overcoating comprising:

I. an organic material comprising a crosslinkable polymeric composition of:

i. a first polymer which is the addition polymerization product of methyl methacrylate, n-butylacrylate and acrylic or methacrylic acid, and ii. a second polymer which is the addition polymerization product of styrene and maleic anhydride, together with II. a particulate wax-like, normally solid, low molecular weight tetrafluoroethylene telomer in an amount from about 15 to 75 weight percent of said overcoating.

2. The photoreceptor of claim 1 wherein the selenium/arsenic alloy contains from about 0.3 to about 48.7 weight percent arsenic.

3. The photoreceptor of claim 1 wherein the selenium/arsenic alloy contains about 37 percent arsenic.

4. The photoreceptor of claim 1 wherein the tetrafluoroethylene telomer is present in an amount of from 25 to 50 weight percent of the overcoating.

5. The photoreceptor of claim 1 wherein the overcoating has a thickness from about 1 to 3 microns.

6. The photoreceptor of claim 1 wherein the molecular weight of the tetrafluoroethylene telomer is from 500 to 100,000.

7. The photoreceptor of claim 6 wherein the molecular weight is from 1,300 to 40,000.

8. The photoreceptor of claim 7 wherein the molecular weight is from 25,000 to 35,000.

9. The photoreceptor of claim 1 wherein the tetrafluoroethylene telomer is in the form of particles or particle agglomerates which range in size from 0.1 $\mu$ to 10 $\mu$ in their longest dimension.

* * * * *